United States Patent [19]

Schroeder

[11] Patent Number: 4,720,694

[45] Date of Patent: Jan. 19, 1988

[54] ELECTROMAGNETIC RELAY

[75] Inventor: Harry Schroeder, Unterhaching, Fed. Rep. of Germany

[73] Assignee: Siemens Aktiengesellschaft, Berlin and Munich, Fed. Rep. of Germany

[21] Appl. No.: 858,921

[22] Filed: May 2, 1986

[30] Foreign Application Priority Data

May 22, 1985 [DE] Fed. Rep. of Germany ..... 3518424
Oct. 30, 1985 [DE] Fed. Rep. of Germany ..... 3538613

[51] Int. Cl.[4] ..... H01H 62/02
[52] U.S. Cl. ..... 335/128; 335/81; 335/85; 335/297
[58] Field of Search ..... 335/78, 80, 81, 85, 335/121, 124, 128, 281, 297, 203

[56] References Cited

U.S. PATENT DOCUMENTS 4,182,998 1/1980 Mueller ..... 335/153
4,292,614 9/1981 Ono ..... 335/202
4,472,699 9/1984 Fujii ..... 335/85

FOREIGN PATENT DOCUMENTS 3128516 3/1983 Fed. Rep. of Germany .

*Primary Examiner*—E. A. Goldberg
*Assistant Examiner*—Lincoln Donovan
*Attorney, Agent, or Firm*—Hill, Van Santen, Steadman & Simpson

[57] ABSTRACT

An electromagnetic relay has a coil member serving as a base body, an armature disposed in an axial bore in the coil member, a yoke at least one section extending outside of the coil parallel to the coil axis, a contact spring with a first section disposed on the yoke and crimped at an end face thereof in front of one flange of the coil member, and at least one further section engaging an extension of the armature. Movement of the armature causes movement of a further portion of the yoke between two switching positions in contact with one of two stationary contact elements. The contact spring is disposed in a channel formed between a leg of the yoke and a cover for the relay. A long free spring length is thus obtained while still maintaining reliable sealing of the contact chamber and a low overall height of the relay.

17 Claims, 8 Drawing Figures

ELECTROMAGNETIC RELAY

BACKGROUND OF THE INVENTION

1. Related Application

This application is related to a co-pending application, filed simultaneously herewith of the same inventor entitled "Electromagnetic Relay" and having Ser. No. 858,814.

2. Field of the Invention

The present invention relates to an electromagnetic relay, and in particular to an electromagnetic relay having a hollow coil member with an armature extending therethrough engaging a spring contact for moving a portion of the spring contact between two switching positions defined by spaced stationary contact elements.

3. Description of the Prior Art

An electromagnetic relay is described in German OS No. 31 28 516 having a coil member which functions as the base body and has a winding thereon forming the coil with a coil axis proceeding parallel to the base plane of the relay. The relay has a yoke cooperating with an armature, the yoke having at least one leg disposed outside of the coil, above or laterally next to the coil, parallel to the coil axis. The armature has at least one portion extending substantially parallel to the coil axis. A contact spring has one spring leg extending substantially parallel to the coil axis outside of the coil and over at least the majority of the coil length. The contact spring leg is crimped in a contact region at its end face in front of one flange of the coil body. The contact spring leg cooperates with at least one stationary contact element anchored in the coil member. The yoke is angled at both ends, i.e., at both flanges, of the coil member. The armature is disposed above the yoke ends.

The relay described above thus has a relatively large overall height because the thickness of the yoke leg is added to the thickness of the armature, and the necessity of a suitable working air gap additionally increases the height. A long contact spring is attached to the armature, however, the connection of the armature to the spring is such that the free spring length, i.e., the moveable portion of the spring, is relatively short. Thus if it is necessary to provide a cross-section for the spring suitable for conducting high currents, a relatively stiff spring results. Moreover, this conventional relay is provided only with a "make" contact. A seal between the coil and the contact space in this relay would be difficult to accomplish due to the shape of the individual parts and the overall structure.

SUMMARY OF THE INVENTION

It is an object of the present invention to provide an electromagnetic relay of the type having a hollow coil member with a coil wound thereabout between two spaced flanges, and a moveable armature extending through the hollow coil body and engaging a contact spring, wherein the contact spring has a free length which is as long as possible while maintaining a relatively small overall height and width of the relay.

A further object of the present invention is to provide such a relay wherein the contact space, in which the moveable parts are disposed, can be reliably sealed in a simple manner from the coil winding as well as from the exterior atmosphere.

The above objects are inventively achieved in an electromagnetic relay wherein the armature extends substantially axially within and through the coil member over the full length of the winding, and wherein the armature has a continuation or extension for contact actuation which projects out of the hollow coil tube or bore in the region of one of the coil flanges. The armature is seated on the yoke in the region of the other coil flange at the other end of the coil. The contact spring is secured to the yoke in proximity to the second coil flange. The contact spring has a first spring leg disposed in a channel formed between the yoke and a housing cover for the relay. A portion of the contact spring disposed in front of the coil flange from which the armature projects is bent substantially perpendicularly to the coil axis and engages the armature extension. Another section of the spring is bent from the armature-engaging section in a direction substantially parallel to the coil axis, which forms a moveable contact for executing switching movement with respect to one or more stationary cooperating contact elements.

A highly effective magnet system is achieved by ranging the armature in the coil member and at the same time the armature does not require any enlargement of the overall height or width of the relay outside of the coil in addition to that which is unavoidable due to the thickness of the yoke. The contact spring, as a result of its location in the channel formed between the yoke and the housing cover, will only slightly increase the overall height or width of the relay while still achieving a relatively long free spring length, even when the relay is sealed.

In one embodiment of the relay, the coil flange from which the armature extension projects forms a contact space surrounded by side walls. The yoke, in combination with the housing cover, forms a channel which is open toward the contact space and closed at all other sides. For this purpose, the yoke has an essential planar surface on which lateral webs of the cover are disposed at three sides of the spring leg adjacent thereto. In another embodiment, the yoke may have sidewalls extending toward the cover, with sealing surfaces of a substantially flat cover section being disposed on the sidewalls of the yoke. The contact space formed by the coil flange may have walls which are open toward at least one side forming planar sealing surfaces for the contact space against which corresponding sealing surfaces of the relay cover are disposed. These sealing surfaces for the contact space on the cover may be an extension of the sealing surfaces which are disposed in registry with the yoke sides.

In another embodiment of the relay, a further spring section is disposed in the region between the spring section adjacent the yoke and the plane of the armature. A tab cut from the spring is bent by 180° and engages the projection of the armature. The yoke together with a portion of the contact spring adjacent thereto are disposed above the coil, "above" being defined with respect to the connecting plane of the relay. Two cooperating contact elements have respective vertical connecting sections anchored in sidewalls of the contact space, i.e., of the coil flange, and have contact sections bent inwardly in opposition to each other so that the further contact spring section is enclosed between the vertically disposed contact elements.

In another embodiment the yoke and the adjacent spring section are disposed laterally of the coil, with respect to the connecting plane, and the cooperating stationary contact element (or elements) has a vertical fastening section anchored in the sidewall of the contact space (flange) with contact sections extending vertically opposite the spring section carrying the moveable contact. In this embodiment, it is preferable that the contact sections of the stationary terminal elements are U-shaped so that an exact fine adjustment of the contact spacings can be undertaken. Additionally for this purpose, the sidewalls of the flange defining the contact space have openings in the region of the contact sections to admit an adjustment tool.

DESCRIPTION OF THE PREFERRED EMBODIMENTS

Figure 1:
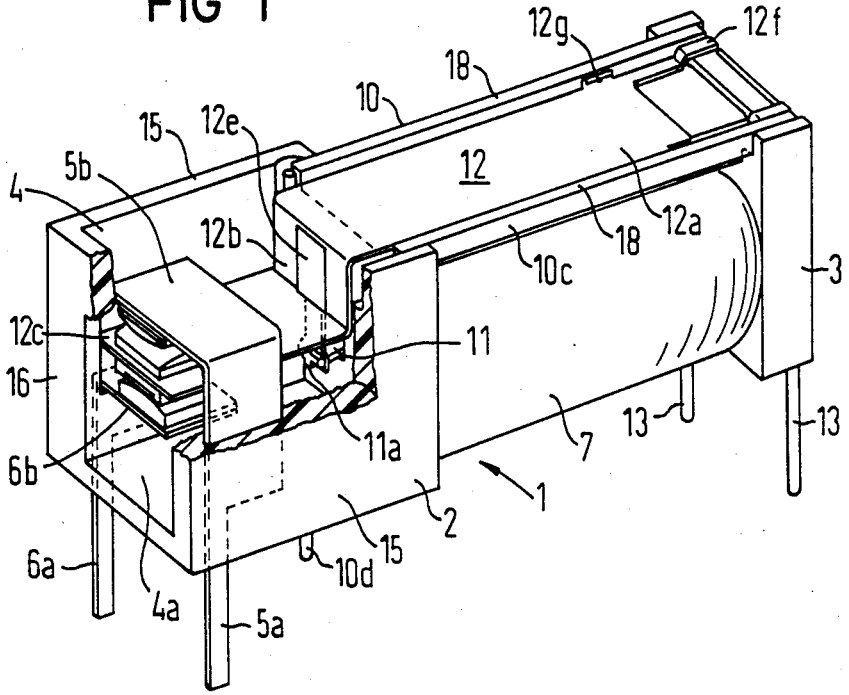
FIG. 1 is a perspective view of one embodiment of a relay constructed in accordance with the principles of the present invention with the cover removed.
Figure 2:
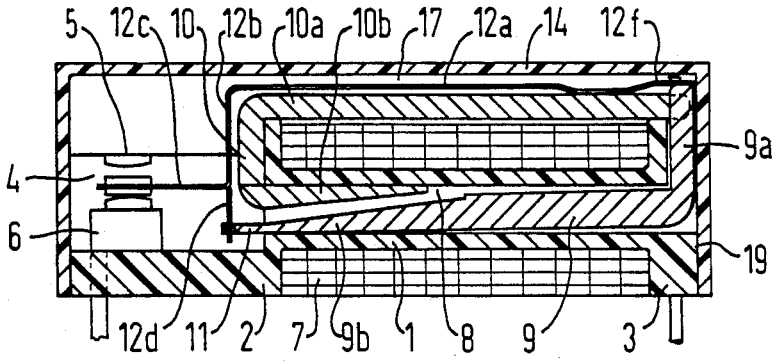
FIG. 2 is a longitudinal section taken through the relay of FIG. 1.

A first embodiment of a relay constructed in accordance with the principles of the present invention is shown in FIGS. 1 and 2. The relay has a coil member 1, serving as a base body, having two spaced flanges 2 and 3. The flange 2 is enlarged and emcompasses a contact space 4. Two stationary cooperating contact elements 5 and 6 are secured in the contact space 4. The coil member 1 has a coil 7 wound thereabout around an axially extending bore 8. An angled armature 9 has a longer leg which extends through the bore 8 in the axial direction. A U-shaped yoke 10 has a longer leg 10*a* extending parallel to the coil axis above the coil (with respect to the base of the relay) and has a wedge-shaped pole piece 10*b* extending into the bore 8. The pole piece 10*b* forms a working air gap with a correspondingly wedge-shaped free end 9*b* of the armature 9. A shorter bearing leg 9*a* of the armature 9 is seated at the termination of the longer yoke leg 10*a*. The armature 9 is mounted at that location for pivotal movement by any suitable bearing such as a knife-edge bearing or a trunnion bearing.

Figure 7:
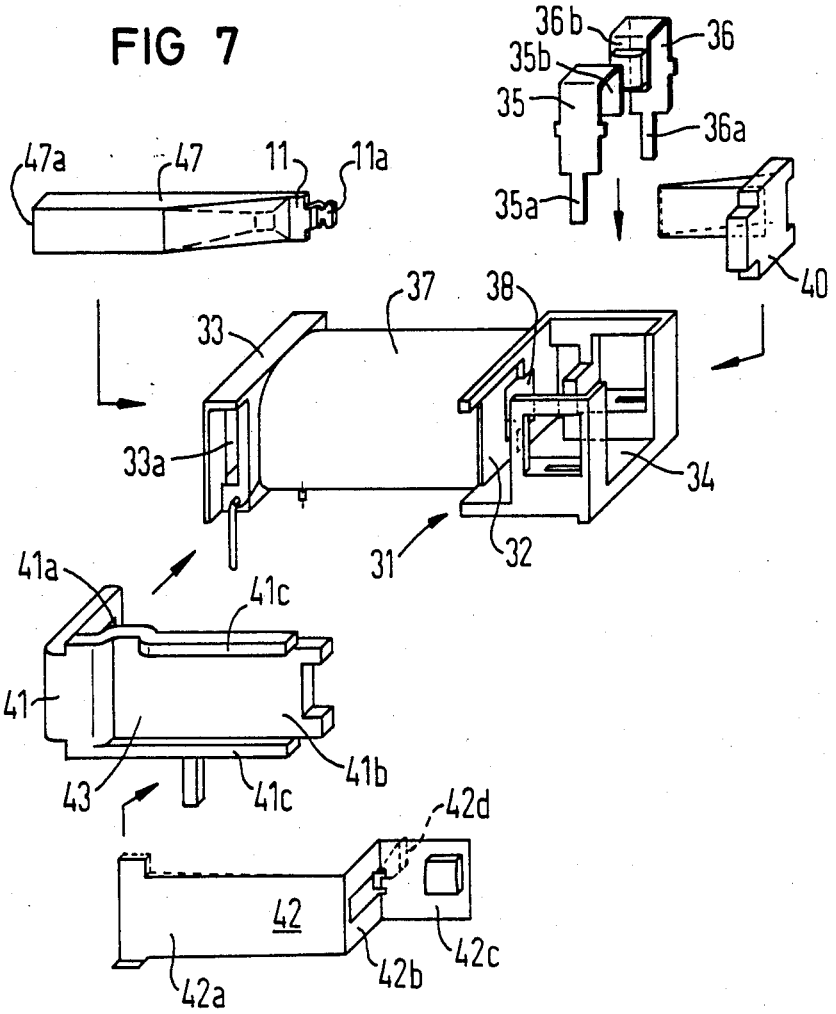
FIG. 7 is an exploded view of another embodiment of the relay constructed in accordance with the principles of the present invention with the armature extending parallel to the plane of integration.

The free or moveable end 9*b* of the armature 9 has a projection 11 extending from the bore 8 and functioning to actuate a contact spring 12. The contact spring 12 has a first spring section 12*a* disposed adjacent the yoke leg 10*a*, and is secured thereto in the region of the armature bearing. A second spring section 12*b* extends in front of the coil flange 2 substantially perpendicular to the coil axis. A third spring section 12*c* is bent from the second spring section 12*b* in a direction substantially parallel to the coil axis. The third spring section 12*c* is moveable for contacting the stationary cooperating contact elements 5 and 6. A tab 12*d* is cut free from the second spring section 12*b* and is bent in a direction perpendicular to the coil axis, as an extension of the second spring section 12*b*, for engaging the armature projection 11. An opening 12*e* is produced in the second spring section 12*b* as a result of the cutting and bending of the tab 12*d*. The first spring section 12*a* has an extension 12*f* beyond the point of attachment with the yoke leg 10*a*. The extension 12*f* is attached to the short armature leg 9*a* and holds that leg in the bearing. Instead of the spring section 12*f*, however, the armature 9 may alternatively be held in the bearing by the spring section 12*d* by providing recesses therein for engaging corresponding recesses 11*a* in the armature projection, as shown in FIG. 7.

The cooperating contact elements 5 and 6 are secured in the coil flange 2, or as described below in the sidewalls of the contact chamber 4, by plugging respective connection elements 5*a* and 6*a* in the coil flange 2. The contact elements 5 and 6 are angled in opposite directions with respect to each other within the contact chamber 4, so that the spring section 12*c*, carrying contact pads thereon, is enclosed between those elements.

The contact spring 12 is connected to the yoke 10 by laterally extending tabs 12*g*. The yoke has a terminal pin 10*d* welded thereon. Standard coil terminal pins 13 are also anchored in the flange 3. The contact chamber 4 has an aperture 4*a* at an end face thereof, so that contact adjustment is possible before the cover 14 is put in place.

Figure 5:
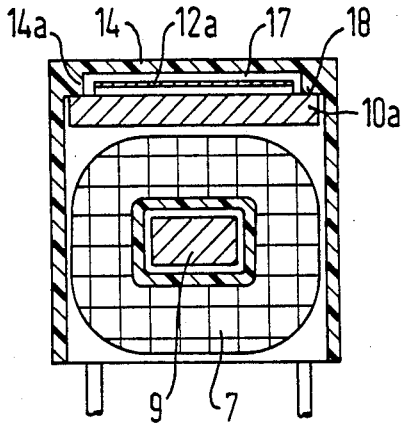
FIG. 5 is a cross-sectional view through the relay shown in FIG. 2.
Figure 6:
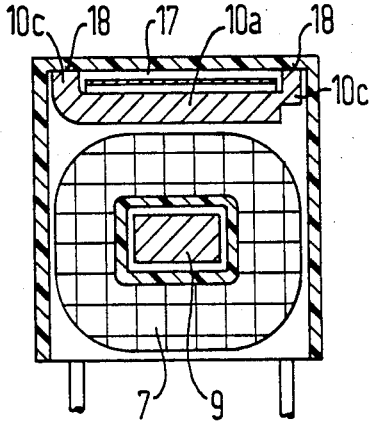
FIG. 6 is a cross-sectional view of a further embodiment of a relay constructed in accordance with the principles of the present invention.

The longer yoke leg 10*a* and the coil member 1 have respective planar sealing surfaces disposed in registry with corresponding planar sealing surfaces in the cover 14 so as to achieve a good separation of the contact chamber 4 from the coil 7 as well as from the outer atmosphere when the cover 14 is sealed thereto. The cover 14 has large surfaces which are disposed against the sidewalls 15 of the contact chamber 4 and against the end face 16 of the contact chamber 4 around the aperture 4*a*. The contact spring section 12*a* is disposed in a channel 17 formed by the yoke leg 10*a* and the cover 14. The channel 17 communicates with the contact chamber 4 and can be reliably sealed from the coil 7. A long free spring length of the contact spring 12 is thus achieved while simultaneously obtaining reliable sealing and without significantly increasing the overall height of the relay. For forming the channel 17, sealing surfaces 18 are provided between the yoke leg 10*a* and the cover 14. Either the yoke leg 10*a* is flat, so that webs 14*a* in the cover 14 are disposed against the yoke leg 10*a* at both sides of the contact spring section 12*a* (FIG. 5), or the yoke leg 10*a* is provided with lateral webs 10*c* bent or stamped in a U-shaped (FIG. 6 and FIG. 1). In both embodiments, the channel 17 is sealed from the coil 7 at both sides, so that the capillary gaps at the sealing surface 18 prevent further flow of casting compound into the spring channel 17 and into the contact chamber 4 when the space surrounding the coil 7 is cast. A further sealing surface 19 is provided at the end face between the coil flange 3 and the cover 14, so that the casting compound does not deteriorate movement of the armature.

Figure 3:
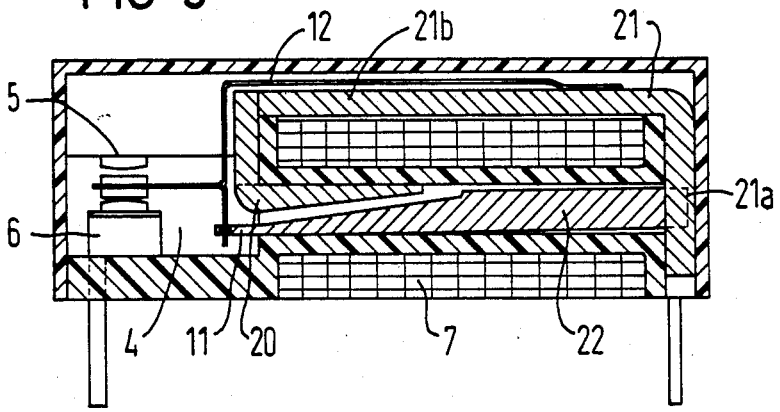
FIG. 3 is a longitudinal section of a further embodiment of the relay constructed in accordance with the principles of the present invention.

A modified embodiment as shown in FIG. 3 wherein a two-piece yoke is provided instead of a U-shaped yoke. The two-piece yoke has a tapered pole piece 20 and an angled yoke member 21. In this embodiment, a bar shaped armature 22 is used instead of the armature 9 shown in FIG. 1 and in dashed lines in FIG. 7. The armature 22 is seated in a recess 21*a* of the angled yoke member 21. The structure and function of the relay shown in FIG. 3 are otherwise the same as already described in connection with the embodiment of FIGS. 1 and 2. As in that embodiment, the armature 22 has a projection 11 which actuates the contact spring 12 as described above. Sealing of the relay can also be undertaken as described above. Because the extension 12*f* of the contact spring 12 is not present in the embodiment shown in FIG. 3, a sealing surface may also be provided between the cover 14 and the angled yoke member 21 behind the free end of the spring section 12*a*, however, this is not shown in detail in the drawings.

Figure 4:
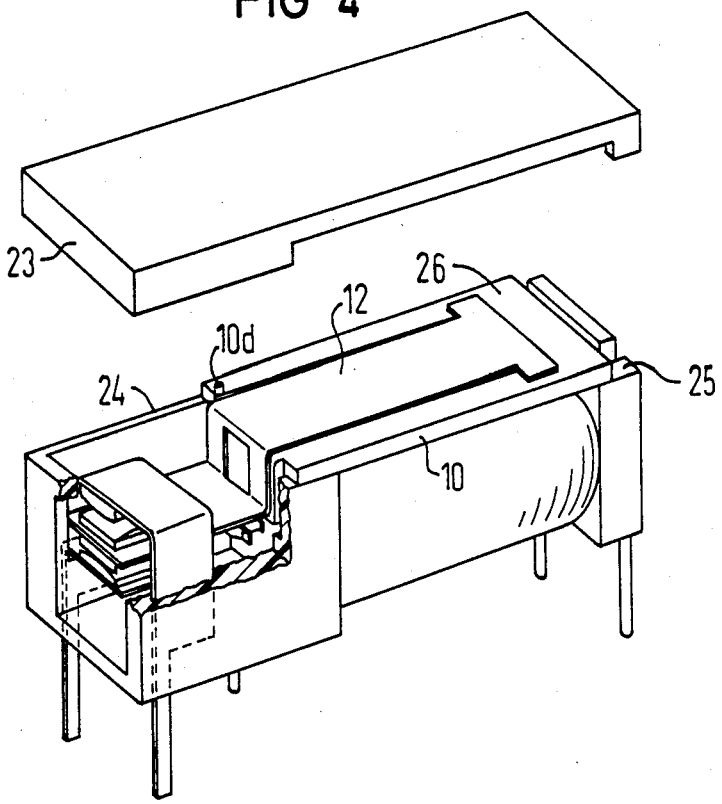
FIG. 4 is a perspective view of another embodiment of a relay constructed in accordance with the principles of the present invention.

The structural element shown in FIGS. 2 and 3 can be combined in other arrangements without department from the inventive concept disclosed herein. One such embodiment is shown in FIG. 4 wherein the armature 9 and the yoke 10 are shaped as shown in FIG. 2, however, the contact spring 12 is secured to the yoke 10 in the manner shown in FIG. 3, i.e., without the use of the spring section 12*f*. A lead for the yoke 10 is disposed in the coil member laterally of the contact spring 12. A flat cover 23 can be provided as shown in FIG. 4, the interior contours thereof being matched to the upper connection surfaces 24 and 25 of the coil member, as well as to the surface 26 of the yoke 10. In this manner, a preliminary sealing of the contact chamber 4 and of the channel 17 can first be undertaken with the cover 23, and additional sealing can then be undertaken by a further cover or an applied foil and by filling the winding space with casting compound.

The structure of the relay can also be modified such that the positions of the yoke and armature are rotated by 90° relative to the plane of integration, so that the armature movement proceeds parallel to the plane of integration. An embodiment of a relay constructed in this manner is shown in exploded view in FIG. 7, and assembled in FIG. 8.

In this embodiment, a coil member 31 having two spaced flanges 32 and 33 is provided, with a contact space 34 formed in the flange 32. Stationary cooperating contact elements 35 and 36 have respective connecting elements 35*a* and 36*a* and respective contacting ends 35*b* and 36*b* which are bent U-shaped in opposite directions so as to be disposed opposite each other in vertical planes.

The coil member 31 carries a winding 37. The components of the magnetic circuit are essentially constructed in the same manner as in FIG. 3, but rotated by 90° in the coil member. An armature 47, which forms a working air gap with a tapered pole piece 40, extends axially through a bore 38 in the coil member 31. The armature 47 has a mounted end 47*a* seated in a bearing recess 41*a* of an angled yoke member 41. The angled yoke member 41 is plugged into a lateral opening 33*a* of the coil flange 33. The yoke member 41 has a leg 41*b* extending parallel to the coil axis, and the angled yoke member 41 forms a channel 43 by means of upwardly bent lateral webs 41*c*. The channel 43 receives a contact spring 42, which is shaped as the contact spring 12 described above. After assembly, a spring section 42*c* is disposed between the two cooperating contact elements 35 and 36, and a spring section 42*d*, which is cut free and bent away, engages the notched end 11*a* of the armature projection 11. As also described, the armature 11 is held in the bearing in this manner.

Figure 8:
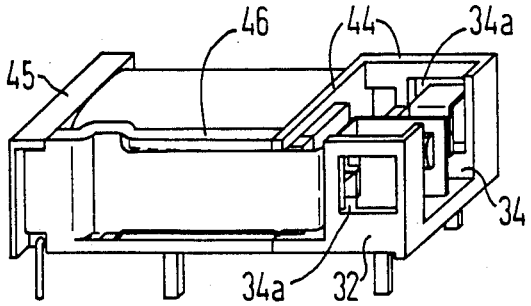
FIG. 8 is a perspective view of the assembled relay of FIG. 7 with the cover removed.

The assembled relay before sealing is shown in FIG. 8. The cooperating contact elements 35 and 36 can still be adjusted because they are accessible from the side through respective apertures 34*a* and the sidewalls of the contact chamber 34. The sealing surfaces are also shown in FIG. 8, permitting planar sealing of a cap or foil so that the winding space can be filled with casting compound without the compound running into the contact chamber 34 or into the channel 43. For example, the cap may be disposed flat against the upper edge 43 of the coil flange 33, which forms a continuous planar surface together with the upper edge 46 of the angled yoke member 41. When filling the winding space with casting compound, a capillary gap is formed as described above, preventing penetration of the casting compound into the contact chamber 34 or into the spring channel 43.

Although modifications and changes may be suggested by those skilled in the art it is the intention of the inventor to embody within the patent warranted hereon all changes and modifications as reasonably and properly come within the scope of his contribution to the art.

I claim as my invention:

1. An electromagnetic relay comprising:

a hollow coil having a longitudinal coil axis;

a magnetic circuit formed by a stationary part and a moveable part responsive to current in said coil each having surfaces disposed in registry forming a working air gap;

a spring having a fixed end attached at one end of said coil and having a first spring section forming a free spring length substantially co-extensive with the length of said coil parallel to said coil axis, a second spring section at an opposite end of said coil perpendicular to said coil axis and engaging said moveable part for co-movement therewith, and a third spring section extending from said second spring section away from said opposite end of said coil and carrying a contact thereon;

at least one stationary contact disposed in said relay for engaging and disengaging said spring contact in response to said coil current; and a cover for said relay, said cover and said stationary part of said magnetic circuit forming in combination a space in which said first section of said spring is received, said space being open toward said stationary contact and otherwise closed.

2. An electromagnetic relay as claimed in claim 1, wherein said moveable part is an armature extending through said coil parallel to said coil axis.

3. An electromagnetic relay as claimed in claim 2, wherein said relay has a terminal plane disposed parallel to said coil axis, wherein said stationary part of said magnetic circuit is disposed above said coil with respective to said terminal plane, and wherein said armature executes movement in a plane perpendicular to said terminal plane.

4. An electromagnetic relay as claimed in claim 2, wherein said relay has a terminal plane, wherein said stationary part of said magnetic circuit is disposed laterally of said coil with respect to said terminal plane, and wherein said armature executes movement in a plane parallel to said terminal plane.

5. A relay as claimed in claim 1, wherein said second section of said spring has a first leg engaging said moveable part of said magnetic circuit, and a second leg disposed substantially perpendicularly to said first leg forming said third section.

6. An electromagnetic relay as claimed in claim 5, wherein said first leg of said second section of said contact spring is a tab cut free from said second section and bent 180°.

7. An electromagnetic relay as claimed in claim 1, wherein said moveable part of said magnetic circuit has a projection engaging said second section of spring.

8. An electromagnetic relay as claimed in claim 1, wherein said stationary part of said magnetic circuit has a channel therein, and wherein said first section of said spring is received in said channel.

9. A relay as claimed in claim 1, further comprising a coil body having spaced flanges and a bore therein, said coil being wound around said bore between said flanges.

10. A relay as claimed in claim 9, wherein one of said flanges has sidewalls and a base defining a contact chamber in which said second and third section of said spring and stationary contact are disposed.

11. A relay as claimed in claim 1, wherein said stationary part of said magnetic circuit has a planar surface spaced from and substantially parallel to an interior surface of said cover, and said cover having lateral webs thereon engaging said planar surface surrounding three sides of said first section of said spring.

12. A relay as claimed in claim 1, wherein said stationary part of said magnetic circuit has webs thereon extending toward and engaging an interior planar surface of said cover and surrounding said first spring section, said interior surface of said cover disposed flat against said webs.

13. A relay as claimed in claim 10, wherein said sidewalls defining said contact chamber are open toward at least one side of said chamber, and further comprising a cover for said relay having sealing surfaces on an interior surface thereof in registry with said open side walls.

14. A relay as claimed in claim 13, wherein at least one of said sidewalls has an aperture therein disposed for admitting an adjustment tool.

15. An electromagnetic relay comprising:

a hollow coil having a longitudinal coil axis;

a magnetic circuit forming a loop outside and through said coil, said loop including a stationary part and a moveable part and being interrupted by a working air gap closable by movement of said moveable part in response to current in said coil;

a spring having a fixed end disposed at one end of said coil and a free end at an opposite end of said coil with a free spring length therebetween, said free end of said spring having a first leg perpendicular to said coil axis engaging said moveable part for co-movement therewith and a second leg parallel to said coil axis carrying a contact thereon;

at least one stationary contact disposed in said relay for electrically connecting and disconnecting with said spring contact in response to said coil current; and a cover for said relay, said cover and said stationary part of said magnetic circuit forming in combination a space in which said free spring length of said spring is received, said space being open toward said stationary contact and otherwise closed.

16. An electromagnetic relay as claimed in claim 15 further comprising a projection on said moveable part of said magnetic circuit disposed for engaging said first leg of said free end of said spring.

17. An electromagnetic relay having a terminal plane and comprising:

a coil body having first and second spaced flanges with a bore extending therethrough and a coil wound therebetween having a coil axis extending parallel to said terminal plane;

at least one stationary contact element mounted in said coil body in the region of said first flange;

a yoke having at least one section extending outside said coil parallel to said coil axis and having a pole plate;

an armature extending through said bore parallel to said coil axis, said armature having a surface disposed for forming a working air gap with said pole plate and having a projection extending from said bore at said first flange;

pivot means engaging said yoke and said armature at said second coil flange for permitting movement of said armature in response to current in said coil;

a contact spring having a first section forming a free spring length having an end attached to said yoke in the region of said second coil flange and extending parallel to said coil axis, a second section perpendicular to said coil axis at said first flange engaging said armature projection for co-movement therewith, and a third section cut and bent from said second section extending parallel to said coil axis for switching with said stationary contact element upon movement of said armature; and a cover for said relay, said cover and said yoke forming in combination a space in which said first section of said spring is received, said space being open toward said stationary contact and otherwise closed.

* * * * *